United States Patent [19]

Pelser et al.

[11] 4,265,680

[45] May 5, 1981

[54] METHOD FOR MAKING HOLLOW MAGNETIC PIPE

[75] Inventors: Robert J. Pelser; Lewis M. Pelser, both of Newbury Park; Robert W. Hill, Westlake Village; Sanford W. Brown, Los Angeles; Robert G. Fischer, Oxnard, all of Calif.

[73] Assignee: Astrolab Corp., Santa Ana, Calif.

[21] Appl. No.: 128,761

[22] Filed: Mar. 10, 1980

[51] Int. Cl.[3] ..... H01F 1/02

[52] U.S. Cl. ..... 148/103; 148/108; 148/121

[58] Field of Search ..... 148/103, 108, 121

[56] References Cited

U.S. PATENT DOCUMENTS

| | | | |
|---|---|---|---|
| 2,382,654 | 8/1945 | Nesbitt et al. | 148/103 X |
| 2,504,870 | 4/1950 | Oliver | 148/103 |
| 3,887,401 | 6/1975 | Hetzel | 148/121 |

*Primary Examiner*—G. Ozaki

*Attorney, Agent, or Firm*—Jessup & Beecher

[57] ABSTRACT

Hollow magnetic pipe having a magnetic field extending across the hollow of the pipe is prepared by a multistep process which includes (a) forming first and second pipe halves from ductile and magnetizable sheet metal, (b) placing the pipe halves in pipelike alignment and joining each pair of adjacently disposed, opened edges thereof with a nonmagnetic seam to form a hollow pipe, (c) conditioning the hollow pipe to receive and maintain a permanent magnetic state, and (d) subjecting the conditioned hollow pipe to a magnetic field whereby the side walls abutting one nonmagnetic seam acquire a permanent north magnetic pole configuration and the side walls abutting the other nonmagnetic seam acquire a permanent south magnetic pole configuration. The hollow magnetic pipe is adapted for use as a conduit for conveying conductive fluid in magnetohydrodynamic energy amplification systems.

9 Claims, No Drawings

METHOD FOR MAKING HOLLOW MAGNETIC PIPE

BACKGROUND OF THE INVENTION

This invention relates to hollow magnetic pipe and, more particularly, to a method for making hollow magnetic pipe having a magnetic field extending across the hollow of the pipe.

The use of magnetic pipe, which has a magnetic field disposed across the pipe hollow, as a conduit for conductive liquids in magnetohydrodynamic energy amplifications systems would be of significant benefit to the art. However, the subjecting of tubular conduit comprising magnetizable material to magnetizing conditions does not produce a permanent-type, hollow magnetic tube having a magnetic field extending across the tube hollow. Accordingly, the principal object of this invention is to provide a method for producing permanent-type magnetic pipe having a high strength magnetic field in the pipe hollow in which the magnetic lines of force are anti-parallel to the longitudinal axis of the pipe.

SUMMARY OF THE INVENTION

In accordance with this invention, there is provided a method for making hollow magnetic pipe having a magnetic field extending across the hollow of the pipe, which comprises:

(a) forming first and second substantially similar pipe halves from ductile and magnetizable sheet metal;

(b) placing said pipe halves in a pipelike configuration having first and second pairs of adjacently disposed open edges and joining each pair of adjacently disposed open edges with a nonmagnetic seam to form a hollow pipe;

(c) conditioning said hollow pipe to receive and maintain a permanent magnetic state; and (d) subjecting said conditioned hollow pipe to a magnetic field whereby each side wall abutting one nonmagnetic seam acquires a permanent north magnetic pole configuration and each side wall abutting the other nonmagnetic seam acquires a permanent south magnetic pole configuration.

DETAILED DESCRIPTION

In one embodiment of the process, first and second substantially corresponding right angle strips having substantially rectangular side walls are formed from ductile and magnetizable sheet metal. The ductile and magnetizable sheet metal generally contains chromium, carbon and iron and may be further formulated to contain cobalt and a ductility enhancing material such as tellurium or vanadium or mixtures thereof. The metal sheet composition advantageously comprises from about 3.15 to about 3.86 wt.% chromium, from about 0.9 to about 1.1 wt.% carbon, and iron to 100 wt.%. Cobalt may be present in an amount from about 2.7 to about 3.3 wt.% together with tellurium or vanadium or mixtures thereof in an amount from about 0.18 to about 0.22 wt.%. In one specific embodiment, the sheet metal has a thickness of about 0.1 inch (0.254 cm) and comprises about 3.5 wt.% chromium, about 1.0 wt.% carbon and about 95.5 wt.% iron. In another specific embodiment, the sheet metal has a thickness of about 0.1 inch (0.254 cm) and comprises about 3.5 wt.% chromium, about 1.0 wt.% carbon, about 3.0 wt.% cobalt, about 0.2 wt.% of tellurium or vanadium or mixtures thereof, and about 92.3 wt.% iron.

The substantially corresponding right angle strips may be prepared by cold forming with a power brake metal working machine wherein the magnetizable and ductile metal sheet is disposed across a V-shaped die having a right angle vortex and a mating, right angle, V-shaped wedge disposed above the sheet metal is actuated to press the sheet metal into the die and to form the sheet into a right angle strip with each leg of the strip having substantially the same dimensions.

After the first and second right angle strips are formed, they are placed in a pipelike configuration having first and second pairs of adjacently disposed open edges in diagonal spaced relationship and each of the pairs of adjacently disposed open edges is joined with a nonmagnetic seam to form a substantially rectangular pipe. When the side walls of the right angle strips have the same dimensions, the hollow pipe has a square perimetrical configuration. Each pair of the adjacently disposed open edges is advantageously joined by a nonmagnetic, welded stainless steel seam. The nonmagnetic seams may be obtained by arc welding under inert gas with 300 series stainless steel.

Upon completion of the welding step, the resulting hollow rectangular pipe is conditioned to receive and maintain a permanent magnetic state. In this phase of the process, the hollow pipe is heated in a heat treating oven at a temperature from about 1,550° F. (843.3° C.) to about 1,750° F. (954.4° C.) for about 30 to about 45 minutes, quenched in a quenching oil to a temperature from about 450° F. (232.2° C.) to about 550° F. (287.8° C.) and then air cooled to ambient temperature.

Following the conditioning step, the hollow rectangular pipe is subjected to a magnetic field whereby each side wall of the pipe abutting one nonmagnetic seam (a north nonmagnetic seam) acquires a permanent north magnetic pole configuration and each side wall of the pipe abutting the other nonmagnetic seam (a south nonmagnetic seam) acquires a permanent south magnetic pole configuration.

The magnetic field for imparting a permanent magnetic state to the pipe may be generated by a magnetizer comprising a U-shaped, direct current pulsator. The pulsator is provided with north and south pole pieces for engaging the side walls of the rectangular pipe formed from the right angle strips. In this connection, the north pole piece engages one wall of one of the right angle strips near the north nonmagnetic seam for imparting a north magnetic pole configuration to this wall and the south pole piece engages the other wall of the same right angle strip near the south nonmagnetic seam for imparting a south magnetic pole configuration to this other wall. The pulsator is then inverted or a second pulsator can be used to impart opposite magnetic pole configurations to the adjoining walls of the other right angle strip with the wall abutting the north nonmagnetic seam acquiring a north magnetic pole configuration and the wall abutting the south nonmagnetic seam acquiring a south magnetic pole configuration. The resulting magnetic pole configuration provides a uniaxial magnetic field which extends across the hollow of the pipe and which is transverse to the longitudinal axis of the pipe. Thus, the alignment of the magnetic field within the hollow of the pipe is antiparallel to the direction of flow of electrically conductive liquid in the pipe. This relationship results in a heat rise when electrically conductive fluid is pumped through the pipe.

The pipe can be prepared in curvilinear or coil form through the use of suitable weld joints or by using other forming techniques and is adapted to acquire a magnetic field within the hollow of significant magnetic strength which is sustainable under diverse operating conditions.

The following example further illustrates the utility of the hollow magnetic pipe prepared in accordance with the method of this invention.

A recirculating fluid flow system was constructed which included a fluid holding tank and a fluid pump interposed in a hollow magnetic pipe line that led from and returned to the holding tank. The tank had a diameter of 18 inches and a height of 36 inches. The hollow magnetic pipe was fabricated in approximately 15 inch sections in accordance with the above-described procedure. The sections were joined by nonmagnetic stainless steel weld joints to provide a recirculating pipe line having a length of approximately 15 feet. The pump utilized in the system was an electrically actuated, 1 horsepower, fluid pump.

A conductive fluid was prepared by heating and admixing a composition comprising 10 wt.% sodium tetraborate, 80 wt.% glycerol an 10 wt.% water at a temperature of about 200° F. until the composition clarified. 65 gallons of conductive fluid, so prepared and having a pH from about 7.6 to about 7.8, were added to the holding tank. The tank discharge valve was opened and the pump was actuated whereby the conductive fluid was recirculated through the hollow magnetic pipe. It was observed, after a period of time and following an initial heat treatment, that the conductive fluid attained a temperature of about 300° F.

In a second embodiment of the method of this invention, the pipe halves are substantially semicircular and the hollow pipe prepared from these pipe halves has a substantially cylindrical configuration. In this embodiment, the substantially similar pipe halves can be prepared by longitudinally bisecting cylindrical pipe fabricated from ductile and magnetizable material. The hollow cylindrical pipe of this embodiment may, advantageously, be subjected to a pressure forming step so as to obtain a hollow pipe having a substantially oblong or eliptical configuration or any other suitable configuration.

In view of the foregoing description, it will become apparent to those of ordinary skill in the art that equivalent modifications thereof may be made without departing from the spirit and scope of this invention.

That which is claimed is:

1. A method for making hollow magnetic pipe having a magnetic field extending across the hollow of the pipe, which comprises:

(a) forming first and second substantially similar pipe halves from ductile and magnetizable sheet metal;

(b) placing said pipe halves in a pipelike configuration having first and second pairs of adjacently disposed open edges and joining each of said pairs of adjacently disposed open edges with a nonmagnetic seam to form a hollow pipe;

(c) conditioning said hollow pipe to receive and maintain a permanent magnetic state; and (d) subjecting said conditioned hollow pipe to a magnetic field whereby each side wall of the pipe abutting one nonmagnetic seam acquires a permanent north magnetic pole configuration and each side wall of the pipe abutting the other nonmagnetic seam acquires a permanent south magnetic pole configuration.

2. The method of claim 1 wherein the ductile and magnetizable sheet metal comprises from about 3.15 to about 3.85 wt.% chromium, from about 0.9 to about 1.1 wt.% carbon and iron to 100 wt.%.

3. The method of claim 1 wherein the ductile and magnetizable sheet metal comprises from about 3.15 to about 3.85 wt.% chromium, from about 0.9 to about 1.1 wt.% carbon, from about 2.7 to about 3.3 wt.% cobalt, from about 0.18 to about 0.22 wt.% of tellurium or vanadium or mixtures thereof, and iron to 100 wt.%.

4. The method of claim 1 wherein the hollow pipe is conditioned to receive and maintain a permanent magnetic state by heating said pipe at a temperature from about 1,550° F. to about 1,750° F. for at least about 30 minutes, quenching said pipe in an oil bath to a temperature from about 450° F. to about 550° F. and air cooling said pipe to ambient temperature.

5. The method of claim 1 wherein the magnetic field, for imparting a permanent magnetic state to said pipe, is generated by a magnetizer comprising a U-shaped, direct current pulsator.

6. The method of claim 1 wherein the nonmagnetic seam joining each pair of adjacent open edges in the pipelike configuration of the cooperating pipe halves is a welded stainless steel seam.

7. The method of claim 1 wherein the pipe halves are substantially right angle strips and the hollow pipe has a substantially square configuration.

8. The method of claim 1 wherein the pipe halves are substantially semicircular and the hollow pipe has a substantially cylindrical configuration.

9. The method of claim 8 which includes the additional step of pressure forming the substantially cylindrical pipe into a hollow pipe having a substantially eliptical configuration.

* * * * *